US006123038A

United States Patent [19]

Kames et al.

[11] Patent Number: 6,123,038

[45] Date of Patent: Sep. 26, 2000

[54] STITCHING MACHINE AND METHOD OF STITCHING

[75] Inventors: Edward D. Kames; Michael V. Schwarzberger, both of Chicago; Neal A. Schwarzberger, Vernon Hills, all of Ill.

[73] Assignee: A.B.M. International, Inc., Elk Grove, Ill.

[21] Appl. No.: 09/217,174

[22] Filed: Dec. 21, 1998

[51] Int. Cl.[7] ..... D05B 11/00

[52] U.S. Cl. ..... 112/117

[58] Field of Search ..... 112/117, 118, 112/119, 304, 305, 311, 470.14, 470.18, 470.12, 470.13, 475.04, 475.07, 475.08, 475.18

[56] References Cited

U.S. PATENT DOCUMENTS

| | | | |
|---|---|---|---|
| 3,382,825 | 5/1968 | Cash | 112/117 |
| 5,136,955 | 8/1992 | Resta et al. | 112/118 |
| 5,182,998 | 2/1993 | Iwase | 112/117 |
| 5,325,802 | 7/1994 | Stutznacker | 112/117 |
| 5,425,319 | 6/1995 | Resta et al. | 112/118 |
| 5,913,277 | 6/1999 | Resta | 112/118 |

*Primary Examiner*—Ismael Izaguirre
*Attorney, Agent, or Firm*—Charles F. Lind

[57] ABSTRACT

The disclosed stitching machine has fabric handling structures, including a rack and rack support structures suited for allowing rack movement between spaced loading/unloading and stitching stations, and clamps on the rack suited for holding fabric for stitching. Flooring structure provided at the loading/unloading station is suited to be shifted between a loading configuration to underlie the rack and support fabric laid thereon until it can be gripped and held by the rack clamps upon such being closed, and an unloading configuration out of the way of an overlying stitched fabric yet held on the rack suited to allow such fabric to fall from the machine upon the rack clamps being opened. Power devices shift such flooring between the loading and unloading configurations, and the rack between the loading/unloading and stitching stations. A sewing machine mounted at the stitching station is controlled to trace out and stitch the fabric as desired.

10 Claims, 7 Drawing Sheets

STITCHING MACHINE AND METHOD OF STITCHING

BACKGROUND OF THE INVENTION

Quilts, comforters, pillow shams and the like frequently might be formed of layered fabric sheets that are stitched together along seams, to hold the sheets and any fill material therebetween positioned in place. The stitching can traverse the layered sheets over much of their exposed areas and moreover can be patterned to be attractive or decorative. Pillow shams might specifically be stitched around the periphery of the fabric layers, inwardly spaced from the outermost edges, for defining the characteristic peripheral flange.

Available stitching machines can form such seams, but the sheet layers most commonly must be manually loaded into or relative to the machine before the stitching can begin, and further commonly must be manually unloaded from the machine after stitching. Further, many currently available automatic handling systems for stitching machines have allowed sufficient shifting of the sheet layers prior to being stitched, that reduces the pattern accuracy and acceptance of the finished goods.

SUMMARY OF THE INVENTION

This invention relates to a machine and method for stitching seams connecting adjacent fabric layers together to form a quilt, comforter, sham or the like, utilizing substantial automation and little operator costs, and yielding high unit output/speed/quality.

The invention specifically teaches a stitching machine and method having substantially automatic sheet layer handling, both prior to and after stitching, thereby relieving the need for an operator to perform these steps manually and reducing associated personnel costs, while further providing that such handling is accurate and consistent for producing seam patterns and finished goods of acceptable high quality.

Basic objects of the invention include providing a stitching machine and method, suited for gripping, squaring up and stretching out flat the fabric layers to be stitched, indexing the gripped fabric layers to a sewing machine for stitching, and returning the stitched fabric layers and releasing then for further processing or the like, with such steps being substantially automatic for minimal operator intervention.

Important features of the inventive machine include having: laterally spaced stitching and loading/unloading stations, and a pre-stitched fabric layer storage tray or bin; with a sewing machine operable at the stitching station and movable along "X"-"Y" coordinates suited to stitch the fabric layers together along any seam/pattern needed; with a rack having clamps suited to grip the opposite side edges of the fabric layers; with mechanism to move the clamped side edges apart and tension the sheets out substantially flat and squared up suited for stitching; with guides and drives for indexing the rack and gripped fabric layers thereon between the stations; and with mechanism for automatically loading and unloading the fabric layers relative to the rack before and after stitching. The mechanisms for loading/unloading fabric layers relative to the rack include having the storage tray hold flat pre-stitched fabric layers, having a sticky bar/clamp arrangement for picking off only the uppermost fabric layer from the bin and firmly clamping it and then drawing it while squared up to the rack to be gripped then by the rack clamps, and having drop flooring operable when closed for supporting the pre-stitched fabric layer before being gripped by the rack clamps and operable when opened for allowing the released seamed fabric layers to drop freely and automatically from control of the machine.

BRIEF DESCRIPTION OF THE DRAWINGS

These and other objects, features or advantages of the invention will be more fully understood and appreciated after consideration of the following description of the invention, which includes as a part thereof the accompanying drawings, wherein.

DETAILED DESCRIPTION OF PREFERRED EMBODIMENT OF THE INVENTION

Figure 1:
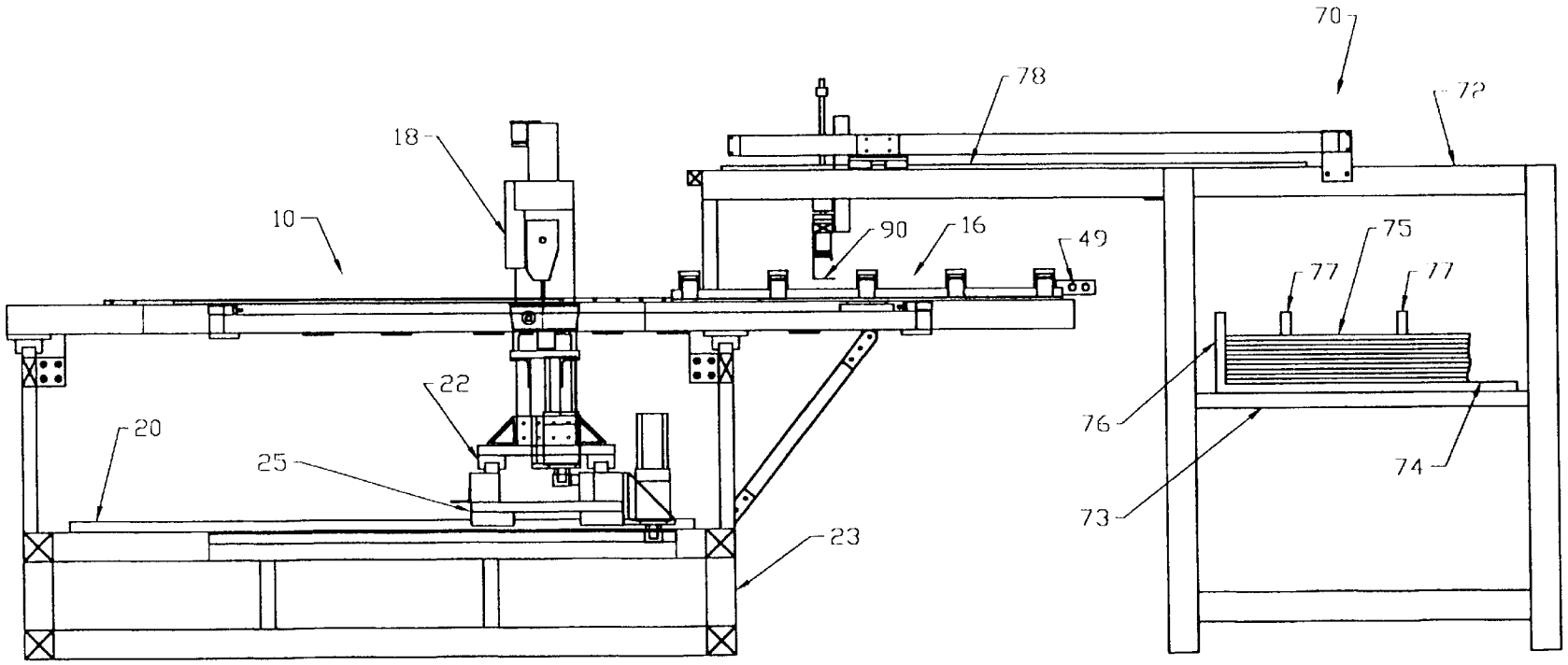
FIG. 1 is a side elevational view of the inventive stitching machine, seen from the side remote from the sewing machine mounting, showing also the adjacent fabric layer loading mechanism working therewith.

The stitching machine 10 and operating method disclosed herein are believed to effectively achieve the stated objects. For clarity and ease of disclosure, not all components or specific details of components are illustrated in all figures where such might appear and be adequately illustrated in another figure; and conventional components may not be illustrated in detail.

The inventive stitching machine 10 is illustrated as having a stitching station 12 and an adjacent loading/unloading station 14, and a rack 16 that is mounted to move operatively between the stations and to carry each set of fabric layers "L" to be stitched in a squared up and tensioned flat condition suited for stitching.

A sewing machine 18 is supported at the stitching station 12 by conventional linear "X" and "Y" guide sets, such as illustrated as rails 20 and 22 transversely arranged relative to one another, with set 20 being interposed via slide means (not numbered) between a stationary base platform 23 supported on the floor and moveable platform 24, and with set 22 being interposed via similar slide means between the moveable platform 24 and another moveable platform 26. The moveable platforms 24, 26 can be powered along the respective rails 20, 22 independently by linear actuators 28, 30, each being illustrated as a motor drive supported on one platform with a rotated pinion 27 operable to engage and roll along a rack 29 mounted along the adjacent platform. The sewing machine 18 is carried on the platform 26, and thus can be moved universally throughout a plane defined by the "X" and "Y" rail sets, to provide any desired pattern of stitching depending on the simultaneous or independent operation and direction of movements of the respective platforms. The linear actuators 28, 30 can be powered by accurate motion control servo-motors and operated by conventional computer controls to produce these sewing machine movements.

Figure 4:
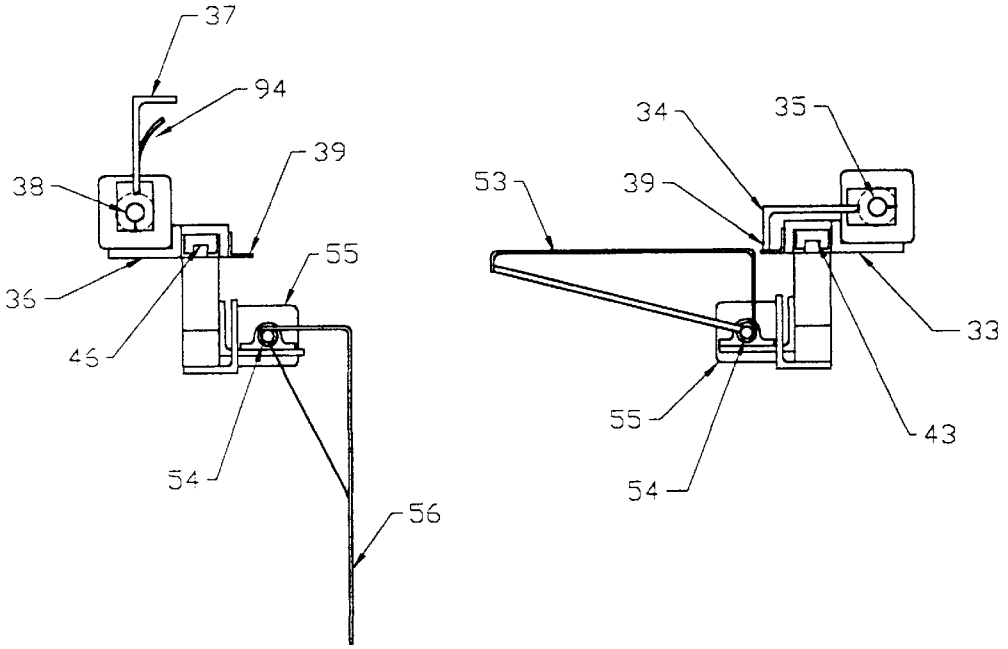
FIG. 4 is a partial section view as taken generally from line 4—4 in FIG. 2, except with the clamps and drop floor panels being shown in different operative positions for each side.
Figure 5:
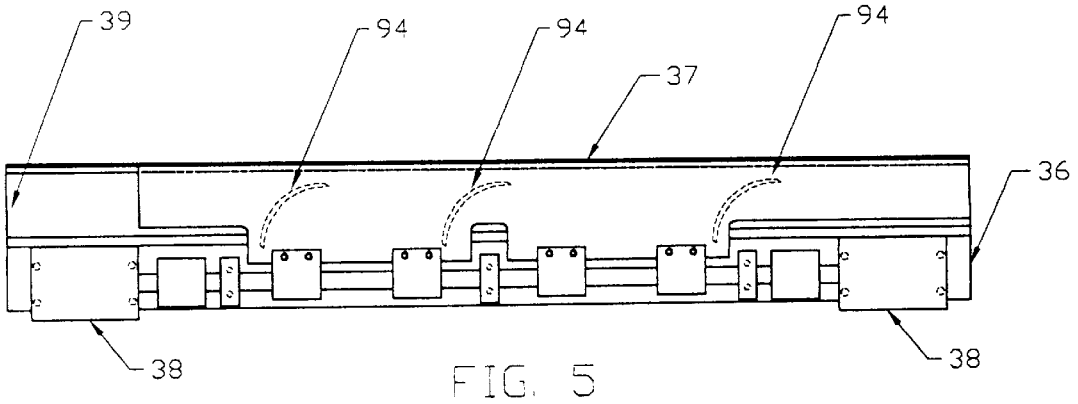
FIG. 5 is a top plan view of one side clamp illustrated in the previous figures.
Figure 6:
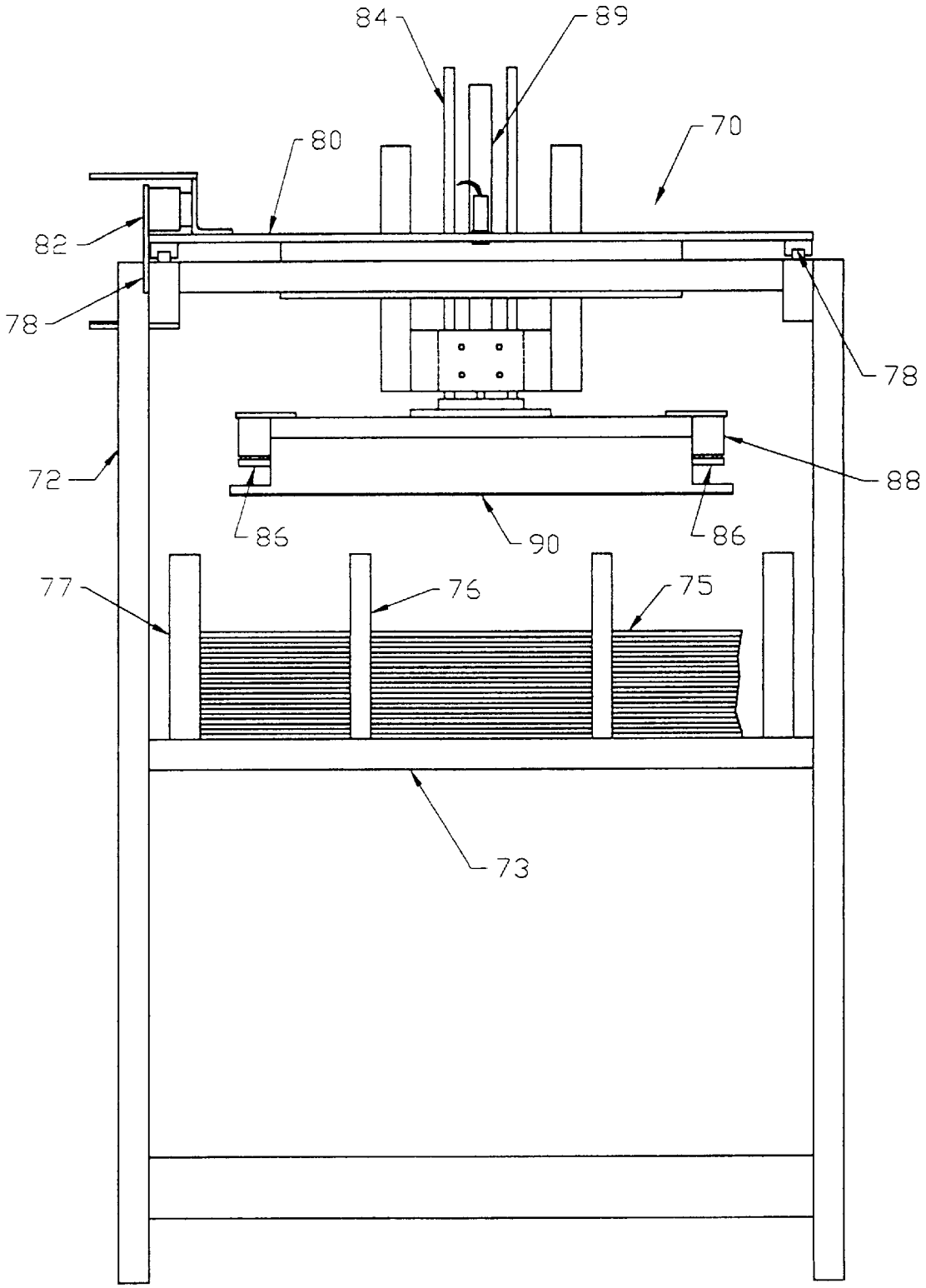
FIG. 6 is an elevational view of the loading mechanism, as seen generally from line 6—6 of FIG. 1, except with the grippers in a withdrawn pick-up position illustrated in FIGS. 7 and 8.
Figure 7:
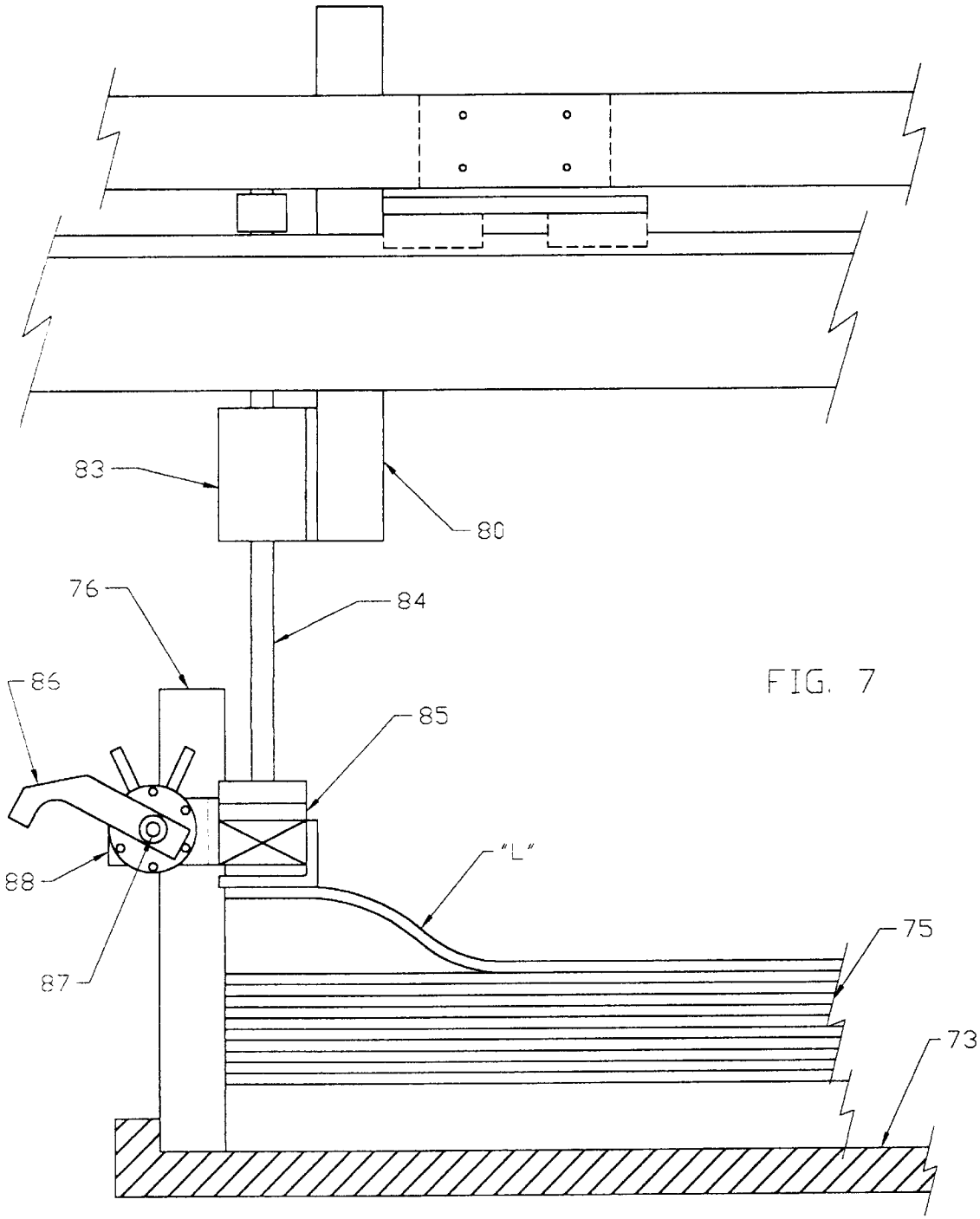
FIGS. 7 and 8 are side elevational views of the loading mechanism, shown in pre-gripped and gripped pick-up positions, respectively each prior to the mechanism being shifted to transfer the fabric layers to the stitching machine.
Figure 8:
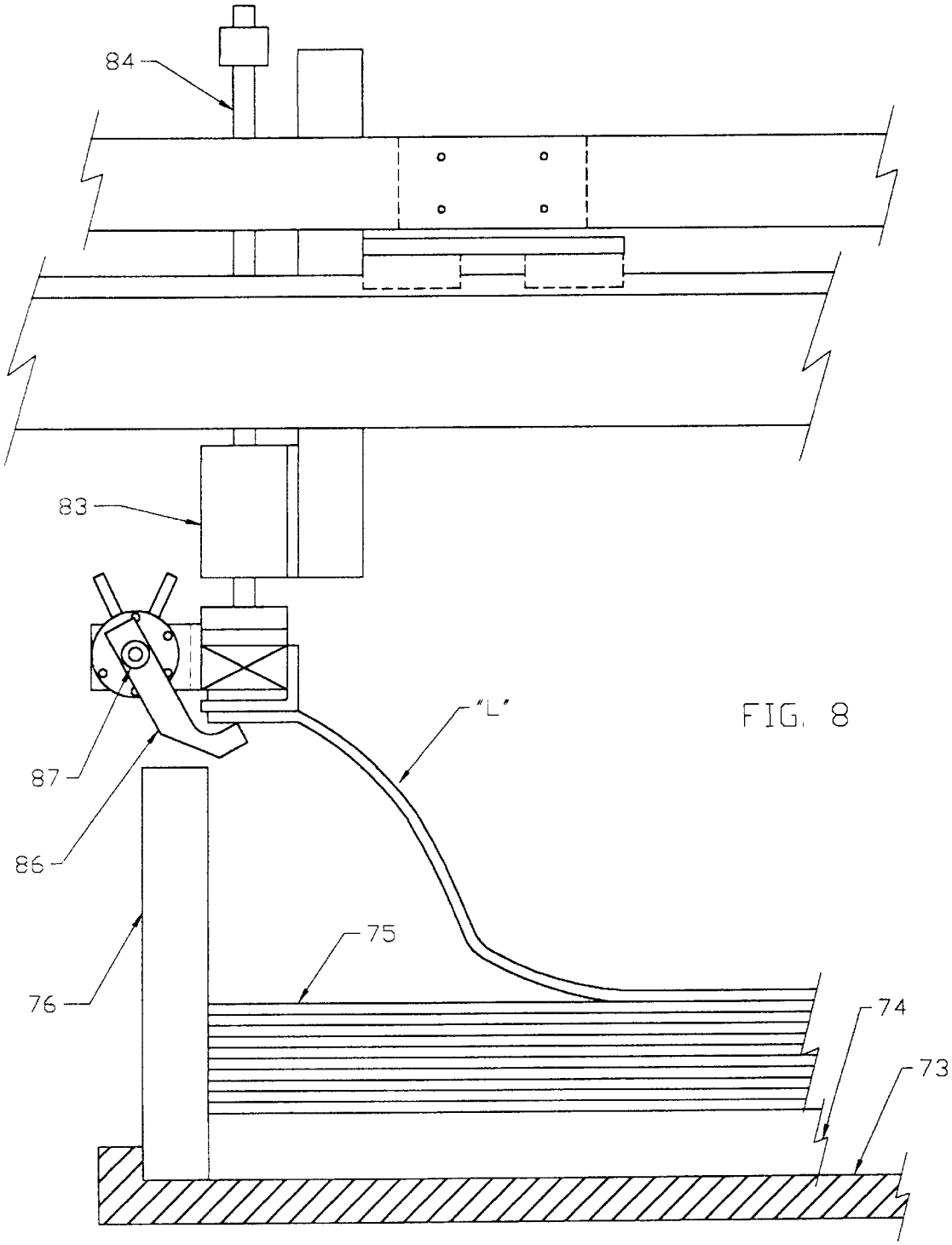

The rack 16 is formed with spaced parallel side bars 33, 36 having inwardly extended lower ledges 39 thereon, and with clamps 34, 37 mounted on the bars and rotated by motor drives 35, 38 so as to be shifted between a clamping position against the ledge (right side clamp 34 of FIG. 4) and an opened position angled upwardly about one-quarter turn therefrom (left side clamp 37 of FIG. 4). Parallel rails 43, 46 extend in the "X" direction (parallel to rails 20) across both the stitching and loading/unloading stations 12, 14, and parallelly underlie the side bars 33, 36; and slide means on the rails provide for axial side bar movements in the "X" direction between the stations 12, 14. The rail 43 is mounted directly relative to the base platform 23; while rail 46 is mounted on platforms 45, where the platforms ride via slide means on cross rails 48 carried on the base platform 23 and disposed substantially perpendicular to the parallel side bars 33, 36. The side bars are coupled together by perpendicularly oriented parallel cross rods 49 mounted to axially slide relative to side bar 33 operable to maintain the side bars squared up, while being moved either axially along rails 43, 46 between stations 12, 14 or laterally toward and away from one another along cross rails 48.

The platform 45 (and the side bar 46 mounted thereon) is powered along the respective cross rails 48 by known linear actuators 50, such as air cylinders, operable to move the rack clamps 34, 37 laterally apart and thereby tension or stretch out flat in the "Y" direction any fabric layers "L" clamped on the rack 16, suited for being stitched. The rack 16 (or side bars 33, 36 specifically) is powered along the respective rails 43, 46 by linear actuator 52, such as a band cylinder connected between the platform 45 and the side bar 36. The positions of the actuator 50 relative to the stationary platform 23 can be adjusted axially along the rails 48 to have the ledges 39 properly spaced apart so as to underlie the opposite side edges of fabric layers of widely different widths. The tensioning forces of the linear actuators 50 can be adjusted as needed by a pressure regulator (not shown) to yield to properly stretched fabric layers.

Figure 2:
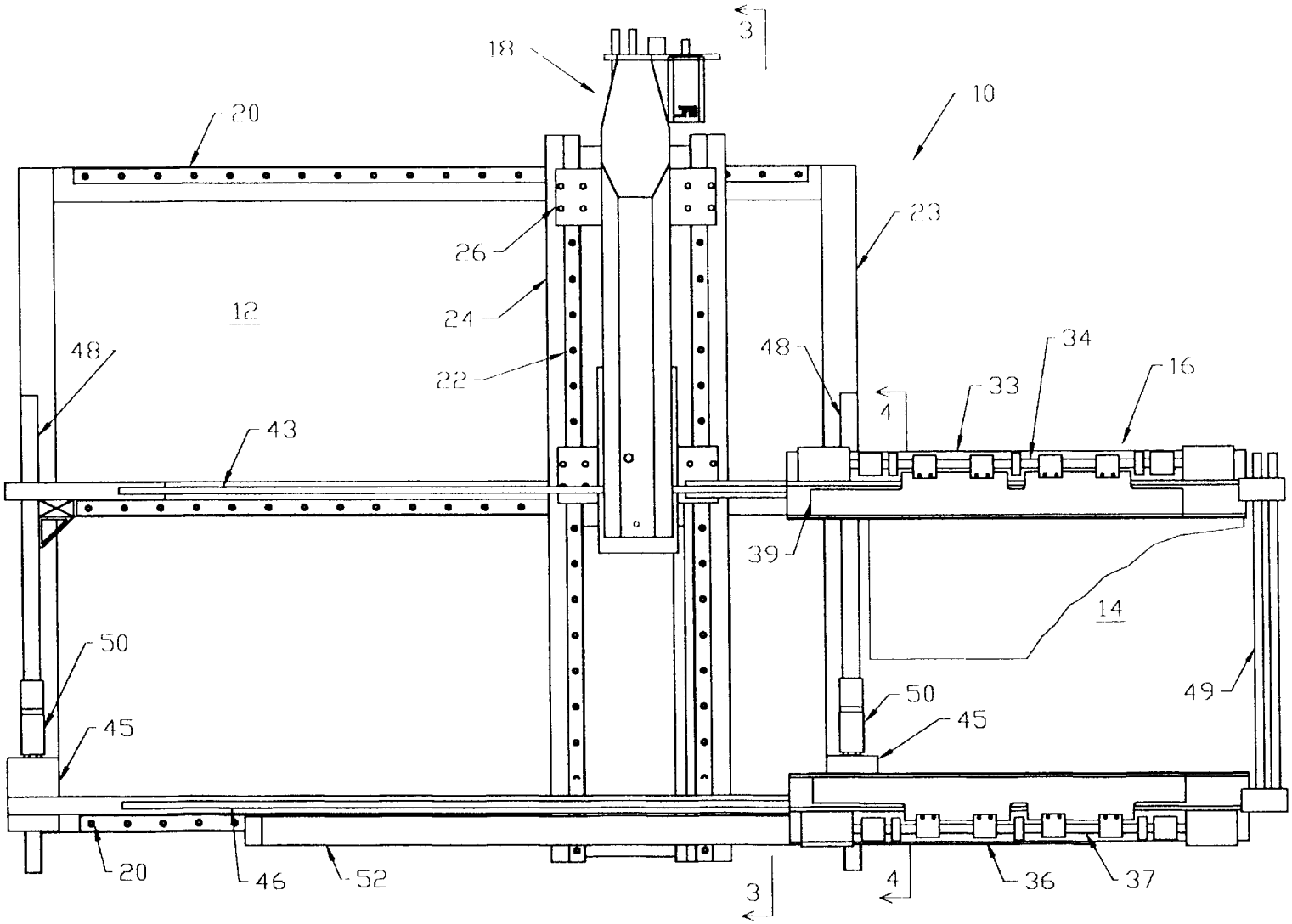
FIG. 2 is a top plan view of the stitching machine, with the loading mechanism shifted out of view for clarity of disclosure.
Figure 3:
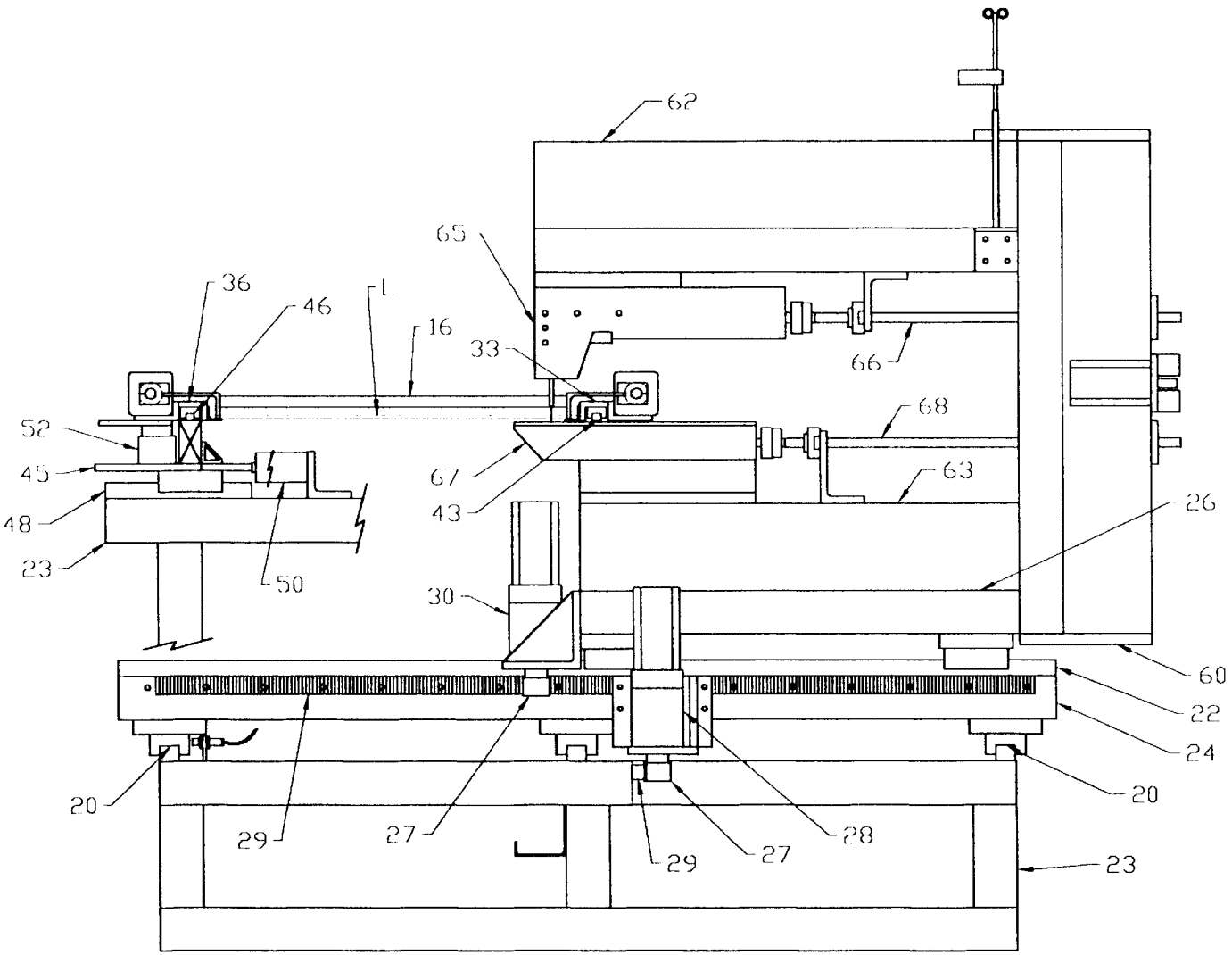
FIG. 3 is a sectional view as taken generally from line 3—3 in FIG. 2.

Shown also in FIGS. 2 and 4 are means to help accommodate automatic loading/unloading of the fabric layers "L" relative to the rack 16. Specifically, the base platform 23 at the loading/unloading station 14 is open (beneath the rack when positioned thereat, FIG. 2) to allow any flexible fabric item unsupported by the rack to fall through to an underlying takeaway conveyor, hopper or the like (none being shown).

Instead, drop flooring is mounted from the base platform with panels 53, 56 to rotate about hinges 54, under power from rotary drives 55, between: generally aligned loading positions extended horizontally between the side bar ledges 39 (as illustrated with panel 53 on the right side of FIG. 4) for supporting pre-stitched fabric layers laid flat out and overlying the rack ledges before being gripped by the rack clamps; and unloading positions rotated to be generally vertical, as illustrated with panel 56 on the left side of FIG. 4 (leaving again the void under a rack positioned at station 14 and thereby allowing released seamed fabric layers to drop from control of the stitching machine 10). The flooring panels 53, 56 in the loading positions will be substantially parallel and the adjacent edges might preferably be slightly overlapped, whereupon the separate drives 55 might be powered slightly out of synchronization to avoid interference of panel edges approaching these parallel positions.

The sewing machine 18 will have drive housing 60 located to one side of the stitching station 12 and substantially parallel arms 62, 63 extended from the drive housing respectively spaced above and below the rack 16 when positioned at the stitching station; and the arms 62, 63 hold opposed cooperating needle or head component 65 and hook or base component 67 on opposite sides of the rack supported fabric layers "L". Actual stitching will be confined within the area of the rack, or between the rack guide rails 43, 46. Conventional structures (not shown) can be used to move the cooperating sewing machine components 65, 67 toward or away from one another, to provide sufficient clearance for indexing the rack and held fabric layers thereon between the various stations 12, 14 without interference, and to have such components against the opposite sides of the fabric layers as needed for stitching. Drive linkages 66, 68 extend from the drive housing to operate the respective sewing machine components 65, 67 in precise unison, as needed. The maximum effective "X" axis and "Y" axis movements of the sewing machine components, and arm lengths, should e approximately the same as the maximum inside length and width dimensions of rack 16, for allowing full potential stitching coverage of the held fabric layers.

Also shown in FIGS. 1, 6, 7 and 8 is lift and load mechanism 70 operable to carry individual sets of the fabric layers "L" automatically relative to the rack 16 of the stitching machine 10, the mechanism being illustrated separate from the stitching machine 10 but positioned immediately adjacent thereto.

The lift and load mechanism 70 includes a frame 72 having a shelf 73 for removably supporting an open top tray or bin 74 sized to hold many sets of pre-stitched fabric layers laid out flat on one another as a stack 75. Guide posts 76, 77 on the tray allow accurate stack positioning, the stack lead edges being squared up against the lead posts 76 and one stack side edges being squared against the adjacent side posts 77. The tray 74 can be accurately stacked with the fabric layers as needed with the tray removed from the mechanism, and the loaded tray can then be accurately positioned and squared up within the mechanism 70. For even greater efficiency, several similar trays can be used alternately.

Spaced parallel guide rails 78 extend horizontally across the top of the frame 72, perpendicular to the lead edge posts 76 of the tray 74, and are projected to overlie rack 16 and be in parallel alignment with the rack guide rails 43, 46. A shuttle member 80 is carried by slide means to ride along the rails 78, with linear actuator 82 (such as a band cylinder) connected between the frame and shuttle member 80 serving to move the member axially alone the rails between opposite positions, respectively overlying the lead end of the tray 74 (see FIGS. 7, 8) and the lead end of the rack 16 when at station 14 (see FIG. 1).

Spaced rods 84 are guided within slide means 83 carried on -the shuttle member 80, and cross bar 85 is connected to the lower ends of the rods squared up with or perpendicular to the rails 78 and extended substantially parallel to the plane of movement of -the shuttle member 80. Spaced gripper fingers 86 are mounted off of the cross bar 85 at gaps between the lead posts 76 of the tray, each gripper finger facing, or opening to, the lead edges of the stack. The gripper fingers 86 are mounted to be rotated around fixed axes 87 by actuators 88 between open or release positions (see FIG. 7) and closed or clamping positions (see FIG. 8).

The cross bar 85 can be moved vertically by power cylinder 89 between lowered and raised positions relative to the shuttle member 80. The cross bar underface 90 might have adhesive thereon (comprising then a sticky bar) suited when lowered against the uppermost fabric layer of the stack 75 of fabric layers to become bonded thereto; whereupon upward bar movement will then lift the lead edge of only the uppermost fabric layer off of the stack (see FIG. 7). When the sticky cross bar 85 is so elevated, the gripper actuators 88 can be actuated to shift the gripper fingers 86 from the release position of FIG. 7 to the clamping position of FIG. 8, for firmly clamping the fabric layers against the cross bar.

This sticky bar attachment to and lifting of only the uppermost of the many sets of stacked fabric layers is most effective and beneficial, as it avoids the frequently experienced malfunction caused when more than the single uppermost set of fabric layers is lifted, as is common with conventionally used pinchers or counter-rotating rollers that also only engage the uppermost fabric layer. The sticky bar can be provided by an adhesive coating directly on the bar surface, by having an adhesive filled cartridge insert secured to the bar for adding fresh adhesive via the bar surface which might be porous for maintaining continuing stickiness, or by having an adhesive tape member adhered over the bar to define the bar surface (the tape being disposable, and being continuously or periodically advanced from a coil to offer an unused sticky surface for each set of fabric layer or being as separate insert pieces periodically removed from and replaced onto the bar 85.

The cross bar 85 will have a vertical operating stroke to reach in the lower position the lowermost fabric layer in the stack 75 on the tray 74 and to elevate in the upper position the lead edge of the gripped fabric layer and grippers 86 to a height above the rack cross rods 49, to allow the grippers to be passed over the rods upon movement of the shuttle member 80 along the rails 78. The downward sticky bar stroke might continue for a timed duration sufficient to ultimately have bar contact with the uppermost fabric layers, regardless of the stack height, before reversal of the bar stroke upwardly.

The rotary actuators 88 can be activated to shift the gripper fingers 86 to the closed position, again possibly after a timed duration of upward stroke sufficient to lift the cross bar 85 clear of the remaining stack (see FIG. 7) so that the grippers can be closed without interference from the remaining fabric layers yet comprising the stack. Moreover, the lead edges of the rack ledges 39 when positioned at the load/unloading station 14 might be extended beyond the corresponding lead edges of the flooring panels 53, 56 to avoid potential interference with the lift and load gripper fingers 86.

If desired, photocells or like sensors might be used to detect the actual presence of fabric layers held against the sticky bar underface 90 before closing the grippers 86, and/or to detect the actual presence of fabric layers on the tray 74 operable then to terminate operation of the mechanism 70 after the last set of fabric layers has been removed from the tray.

After the gripper fingers 86 have been closed to firmly hold the leading edge of the fabric layer, the upward stroke of cross bar 85 is continued to its upper position. The shuttle member 80 can then be shifted by band cylinder 82 to it extended position overlying the lead edge of the rack 16 at station 14, where the cross rods 49 at the trailing edge of the rack provide support for the trailing remainder of the gripped fabric layers being pulled over and onto the rack 16.

The lift and load mechanism 70 will be positioned relative to the rack 16 so that the rack and shuttle rails 43, 78 will be parallel and horizontally referenced for having the corresponding side edge of the fabric layers held on the cross bar 85 overlie the adjacent rack ledge 49 accurately. The other rails 46, 79 will be adjustably mounted to be properly spaced from the reference rails for the particular fabric layers being stitched, so that the side edges of the fabric layers accurately overlie the rack ledges 49.

Further, shuttle bar advance and corresponding movement of cross bar 85 will be set to pull the lead edge of the fabric layers accurately to the lead edge of the rack, so that the side edges will automatically slide along on the rack ledges 49. Of particular importance, the held fabric layers "L" on the bar 85 will be squared up with the rack 16 and the unsupported mid-portion of the fabric layers will be supported by the closed drop flooring panels 53, 56. When so positioned, the rack clamps 34, 37 can be closed to grip the fabric layers along the side edges.

Upon the rack clamps closing, the lift and load mechanism gripper fingers 86 can be opened, the cross bar 85 can be moved vertically by power cylinder 89 to the raised positions relative to the shuttle member 80, and the shuttle member can be returned by the linear actuator 82 to overlie the tray 74. Further, stretching actuators 50 can be activated to shift the rack rail 46 and side clamps 37 away from the clamps 34, operable to tension or stretch out the fabric layers held on the rack to a substantially flat configuration suited to be stitched.

The rack 16 could then be indexed from the loading/unloading station 14 to the stitching station 12, and the fabric layers yet secured thereon can be stitched by the sewing machine 18. When this is completed, the rack 16 will be returned to the loading/unloading station 14; but the drop floor panels 53, 56 will also then be opened or opening upon activation of the actuators 55, so that upon the rack reaching the station 14 and the rack clamps 34, 37 being opened, the stitched or seamed product will be allowed to fall freely from control of the stitching machine for subsequent processing as needed.

The plane defined by the fabric sheet layers "L" held by the rack 16, the plane of rack movement between the stations 12, 14 and the plane of the sewing machine movement will all be parallel.

Suitable limit devices might be triggered upon the rack 16 being properly positioned in the respective stations 12, 14, to control the rack actuator 52. Also, proximity switches (such as magnetic switches) might be provided along the power cylinder 86 to sense the uppermost raised position needed to clear the rack cross rods 49 and the lower position effective to have the suspended fabric layers generally aligned with the rack ledges 39. The actual actuation of the mentioned actuators further can be operated in the needed sequences by conventional computer controls.

One further option might provide that low force drag means (such as formed with a spring wire 94) can be mounted on each rack clamps so as to be biased against the fabric layers and underlying rack ledges when the rack clamps are partly closed but yet gapped from actual contact with the fabric layers. The slight drag the springs provide against the fabric layer edges sliding along on the rack ledges when pulling the fabric layers only from the lead edge seems to help minimize furled fabric layer edges.

It thus can be appreciated that a stack 75 of fabric layers to be stitched can be manually and accurately positioned on the tray 74 and within the lift and load mechanism 70. The squared-up association of the mechanism 70 and stitching machine 10, including the mobile rack 16 and its positive tensioning of the held fabric layers, will provide very accurate, automatic and consistent position of the fabric layers and sewing machine 18, for improved quality stitching even without the need of constant operator intervention. The loading/unloading, clamping/releasing and indexing cycles can be carried out substantially by means of limit detectors and conventional computer controls now used in the stitching machine art.

While a specific embodiment has been illustrated, it will be obvious that minor changes could be made therefrom without departing from the spirit of the invention. Accordingly, the invention is to determined by the scope of the following claims.

What is claimed is:

1. A machine for stitching flexible fabric layers together along seams inwardly of the periphery thereof, comprising the combination of a rack, clamp means on the rack suited to grip and hold opposite edges of the fabric layers with the held fabric layers substantially tight and flat suited for stitching, and means for opening and closing the clamp means;

linear drive structure for supporting the rack for movement along "X" directions between a loading/unloading station and a stitching station, and means for powering the rack to and between the stations;

a sewing machine having opposed head and base components suited to be located on opposite sides of the planar sheet layers when held at the stitching station, "X"-"Y" structures for supporting the sewing machine for movement of the sewing machine components in unison substantially parallel and relative to the flat sheet layers as held at the stitching station, and means for powering the "X"-"Y" structures and the sewing machine components to trace out and stitch the desired seams; and flooring structures at the loading/unloading station, and means for shifting such structures between: loading positions underlying the rack operable to support the fabric layers before being gripped by the closed rack clamp means and having the seams stitched, and unloading positions operable to allow the seamed fabric layers to fall from the machine after opening the rack clamp means at the loading/unloading station.

2. A stitching machine according to claim 1, comprising the combination of lift and load mechanism for automatically picking off only an uppermost set of fabric layers arranged in a vertical stack, said mechanism including a sticky bar and means to move the sticky bar downwardly against the uppermost fabric layer to become bonded thereto and thereafter to move the sticky bar upwardly to draw the bonded uppermost set of fabric layers upwardly off of the stack, and means to move the sticky bar to overlie the rack at the loading/unloadinq station and the flooring structures in the loading positions.

3. A stitching machine according to claim 1, comprising the combination of lift and load mechanism for automatically picking off only an uppermost set of fabric layers arranged in a vertical stack, said mechanism including gripping means effective to hold onto the uppermost set of fabric layers, and means to move the gripping means to draw the fabric layers off of the stack and to move it to overlie the rack and flooring structures at the loading/unloading station.

4. A machine for stitching flexible fabric layers together along seams inwardly of the periphery thereof, comprising the combination of lift and load mechanism for automatically picking off only an uppermost set of fabric layers arranged in a vertical stack, said mechanism including a sticky bar and means to move the sticky bar downwardly against the uppermost fabric layer to become bonded thereto and thereafter to move the sticky bar upwardly to draw the bonded uppermost set of fabric layers upwardly off of the stack, grippers carried adjacent the sticky bar, and means to shift the grippers between: clamping positions overlying and firmly holding the fabric layers bonded to the sticky bar, and release positions spaced from the sticky bar.

5. A method of stitching flexible fabric layers together along seams inwardly of the periphery thereof, comprising the steps of laying out one set of the fabric layers on a substantially flat underlying support surface at a loading/unloading station and clamping opposite side edges of the fabric layers to a mobile rack positioned at said loading/unloading station, increasing the spacing between the clamped side edges to tension the held fabric layers substantially tight and flat suited for stitching, indexing the mobile rack and tensioned fabric layers from said load/unloading station to a stitching station whereat stitching can take place, returning the rack and tensioned and seamed fabric layers to the loading/unloading station and removing the support surface thereat, and releasing the clamped side edges of the seamed fabric layers and allowing such layers to fall from control of the rack and from the loading/unloading station.

6. A stitching method according to claim 5, comprising the additional steps of automatically picking off only an uppermost set of fabric layers arranged in a vertical stack by lowering a sticky bar downwardly against the uppermost fabric layer to become bonded thereto and thereafter raising the sticky bar upwardly to separate the bonded uppermost set of fabric layers from the remainder of the stack, and moving the sticky bar to overlie the rack and flat support surface at the loading/unloading stations.

7. A stitching method according to claim 6, comprising the additional steps of mechanically clamping and firmly holding the fabric layers bonded to the sticky bar relative to the sticky bar before moving the sticky bar to overlie the rack and flat support surface at the loading/unloading stations, and releasing the mechanical clamping of the fabric layers when overlying the rack and flat support surface at the loading/unloading stations and before the spacing between clamped opposite side edges of the is increased to tension the held fabric layers to substantially tight and flat configuration suited for being stitched.

8. A stitching method according to claim 5, comprising the additional steps of automatically picking off an uppermost set of fabric layers arranged in a vertical stack by means of a movable gripping mechanism, moving the gripping mechanism and set of fabric layers to overlie the rack and flat support surface at the loading/unloadinq stations, and then releasing the fabric layers.

9. A machine for stitching flexible fabric layers together along seams, comprising the combination of a rack, clamp means on the rack suited to grip and hold opposite edges of the fabric layers, means for opening and closing the clamp means; and means for separating the closed clamp means laterally apart to tension the held fabric layers substantially tight and flat suited for stitching;

drive structure for supporting the rack for movement between: a loading/unloading station whereat the fabric layers can be clamped to or released from the rack, and a stitching station; and means for powering the rack between the stations;

flooring structures at the loading/unloading station, and means for shifting such structures between: loading positions Underlying the rack operable to support the fabric layers before being gripped by the closed rack clamp means, and unloading positions out of the way of the seamed fabric layers held on the tack at the loading/unloading station, operable to allow the seamed fabric layers to fall from the machine upon opening the rack clamp means; and a sewing machine located at the stitching station, and means for powering the sewing machine to trace out and stitch the desired seams.

10. A stitching machine according to claim 9, comprising the combination of lift and load mechanism for automatically picking off the uppermost set of fabric layers arranged in a vertical stack, said mechanism including gripping means effective to hold onto the uppermost set of fabric layers, and means to move the gripping means to move the held uppermost set of fabric layers off of the stack and over the rack and the flooring structures at the loading/unloading station.

* * * * *